US005245388A

United States Patent [19]

Rydelek et al.

[11] Patent Number: 5,245,388

[45] Date of Patent: Sep. 14, 1993

[54] IMAGE FORMING APPARATUS INCLUDING INDEXIBLE TONING UNITS

[75] Inventors: James G. Rydelek, Rochester; Michael L. DeCecca; David R. McDougal, both of Fairport; Arthur E. Dunn, Rochester, all of N.Y.

[73] Assignee: Eastman Kodak Company, Rochester, N.Y.

[21] Appl. No.: 874,310

[22] Filed: Apr. 27, 1992

[51] Int. Cl.[5] ..... G03G 15/01; G03G 15/06

[52] U.S. Cl. ..... 355/245; 355/326

[58] Field of Search ..... 355/259, 326, 327, 245

[56] References Cited

U.S. PATENT DOCUMENTS

| | | | |
|---|---|---|---|
| 3,709,594 | 1/1973 | Hastwell | 355/327 |
| 4,017,171 | 4/1977 | Wick et al. | 355/327 |
| 4,410,259 | 10/1983 | Yamagata et al. | 355/259 |
| 4,710,016 | 12/1987 | Waatanabe | 355/326 |
| 4,891,674 | 1/1990 | Seyfried | 355/326 X |
| 4,922,302 | 5/1990 | Hill et al. | 355/260 X |
| 4,928,146 | 5/1990 | Yamada | 355/326 X |
| 5,030,988 | 7/1991 | Haneda et al. | 355/326 X |
| 5,111,245 | 5/1992 | De Cecca et al. | 355/326 X |

OTHER PUBLICATIONS

U.S. patent application Ser. No. 07/621,681, filed Dec. 3, 1990, of Kroll et al.

U.S. patent application Ser. No. 07/632,706, filed Dec. 24, 1990, of DeCecca et al.

*Primary Examiner*—Fred L. Braun

*Attorney, Agent, or Firm*—Leonard W. Treash, Jr.

[57] ABSTRACT

Image forming apparatus includes a photoconductive drum cartridge which has an opening through which toner is applied to an electrostatic image formed on the photoconductive drum. To provide more than one color, a development device includes four toning units which are indexible into alignment with the toning opening in the cartridge. Each toning unit includes an applicator assembly at the top of the unit which is movable with respect to the rest of the unit toward the toning opening. A resilient lift mechanism engages a pair of ledges at opposite ends of the applicator assembly and is actuatable to move the applicator assembly toward the toning opening. A sensor senses arrival of each toning unit in a position aligned with the toning opening. A logic and control in response to a signal from the sensor rotates a cam member which is resiliently coupled to the pins for moving the applicator assembly. The applicator assembly includes three positioning protrusions that seat on flat surfaces adjacent ends of the opening in the cartridge.

11 Claims, 7 Drawing Sheets

IMAGE FORMING APPARATUS INCLUDING INDEXIBLE TONING UNITS

This invention relates to the application of toner to electrostatic images to create toner images. It is particularly usable in an image forming apparatus in which toner from a plurality of toning units is applied to electrostatic images on an image member at a single toning position.

U.S. Pat. application Ser. No. 07/621,681, filed Dec. 3, 1990, now U.S. Pat. No. 5,182,608, to Arthur S. Kroll et al, describes an image forming apparatus in which a drum-shaped image member is replaced in the apparatus in a cartridge. The cartridge may also include charging and cleaning devices. The cartridge has a housing with openings through which the image member is exposed, toned and toner images are transferred.

To provide multicolor images, a series of four toning units are movable through a position aligned with a toning position associated with the toning opening in the cartridge. Each toning unit has an applicator which is movable relative to the rest of the unit. As each toning unit is moved into alignment with the toning position, a ramp opposite the toning position pushes an applicator in the top of the toning unit into the toning position. The applicator is in an applicator assembly which includes positioning structure which cooperates with the complimentary positioning structure on the receiving cartridge to accurately locate the applicator with respect to the image member.

The four toning units are mounted in a single carriage which is reciprocally driven to index the units by single motor. Because movement of the applicator assembly is accomplished off a stationary ramp, the same motor supplies the force for movement of the applicator assembly as well. This structure has the advantage of a single motor which drives both the indexing and applicator positioning. To prevent movement of the applicator during return movement of the units, the ramp is movable out of the way by a solenoid during such return movement.

Applicator positioning with respect to the image member can be accomplished by several mechanisms disclosed in the prior application. For example, four rollers are positioned, one on each side of the applicator, at each end of the applicator to engage the drum-shaped image member and roll on it during operation while spacing the applicator from the image member.

The structure shown in this prior patent application incorporates the remarkable invention of moving only the applicator for final positioning of the toning unit rather than the entire toning unit as shown in other prior art. Moving only the applicator greatly reduces the energy required for final positioning and allows at least the main portions of all of the units to be fixed with respect to each other, for example, in a single integral carriage. It also permits the use of toner supply packaging which moves with the units, which is not easily done if the developer mixing portions must move in two orthogonal directions.

DISCLOSURE OF THE INVENTION

It is an object of the invention to simplify and to improve the reliability of the structure disclosed in the prior application cited above, while retaining the advantages of an applicator assembly which moves independently of the rest of the station.

This and other objects are accomplished by an image forming apparatus which includes an image member, means for forming an electrostatic image on the image member, means for applying toner to the electrostatic image to form a toner image corresponding to the electrostatic image. The toner applying means includes a plurality of toning units indexible into alignment with a toning position associated with the image member. Each toning unit includes an applicator assembly which is movable with respect to the rest of the unit toward the toning position as in the apparatus disclosed in the Kroll et al application referred to above. Movement of the applicator assembly is controlled electromagnetically in response to an electrical signal that the toning unit is aligned, or becoming aligned, with the toning position.

According to a preferred embodiment, an electromechanically driven lift mechanism, preferably driven by a motor and permanently associated with the toning position, engages the applicator assembly and moves the applicator assembly toward the toning position in response to a signal that the toning unit is aligned with the toning position. Preferably, the applicator assembly is moved toward the toning position through a resilient coupling.

According to a further preferred embodiment, a drive motor is connected to a cam means which has first and second positions corresponding to applicator "up" and "down" positions, respectively. First sensing means are provided for sensing whether the cam means is in its first or second position. Second sensing means are provided for sensing the arrival of a toning unit in a position aligned with the toning position. In response to a signal from the second sensing means indicating arrival of a toning unit at a position generally opposite the toning position, the motor rotates the cam means until the first sensing means senses that the cam means is in its second position.

According to a further preferred embodiment, the image member is supplied in the image forming apparatus in a replaceable cartridge. The cartridge includes a housing for holding the image member, which housing has a toning opening with respect to which the applicator of a toning unit is positionable. Complimentary positioning surfaces on the cartridge, adjacent the toning opening, and on a surface of the applicator assembly engage each other to provide a desired positional relationship between the applicator and the image member. Preferably, the positioning surface (or surfaces) on the cartridge is a flat surface perpendicular to a plane through the axis of rotation of the image member at the toning position. The comparable surface on the applicator assembly is also a flat surface facing the flat surface on the cartridge, which flat surface on the applicator assembly includes two positioning protrusions at one end of the applicator and a single protrusion at the other, which engage the flat positioning surface on the cartridge when the applicator is moved toward the toning position. The resilient coupling on the lift mechanism lifts the applicator assembly until the surfaces seat on each other and then resiliently absorbs further movement of the cam means.

DISCLOSURE OF THE PREFERRED EMBODIMENTS

Figure 1:
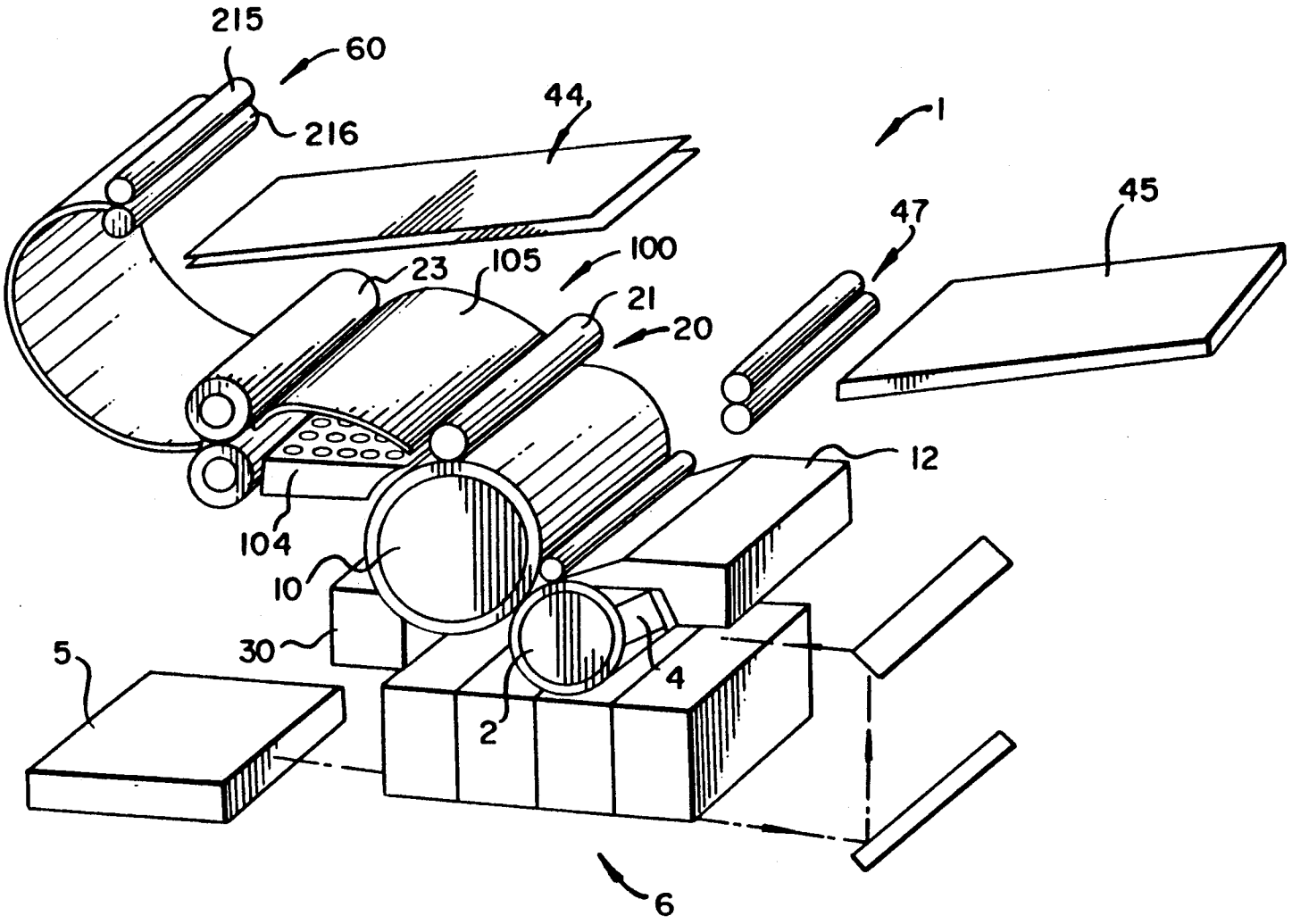
FIG. 1 is a perspective schematic of an image forming apparatus in which the invention is utilized.

According to FIG. 1, an image forming apparatus 1 includes an image member, for example, a photoconductive drum 2, which is rotatable to form different color toner images on an outside peripheral image surface. More specifically, the image surface of drum 2 is uniformly charged by a corona charger 4 and imagewise exposed by a laser 5 to form a series of electrostatic images on the image surface. Electrostatic images are toned by a toning device 6 to form a series of toner images of different colors. The toning device 6 contains four toning units, each with a different color toner, which are indexed through a single toning position to apply a different color toner to each of the electrostatic images. This structure will be more extensively described with respect to FIGS. 2 through 9.

The different color toner images are transferred to the outside surface of a transfer drum 10 in registration to form a single multicolor image. The single multicolor image is transferred to a receiving sheet which is fed from a receiving sheet supply 45 into a nip between a transfer backup roller 21 and the transfer drum 10. The receiving sheet is transported from the transfer nip to a fuser 23 by a receiving sheet transport 100, where the multicolor image is fixed to the receiving sheet. The receiving sheet is fed by the fuser to a pair of exit rollers 60 which feed the sheet to an output hopper 44.

The transfer drum 10 is intermittently cleaned by a transfer drum cleaning device 30. The image surface of photoconductive drum 2 is continuously cleaned by a cleaning device 12. As will be seen with respect to other more detailed FIGS., photoconductive drum 2, corona charger 4 and cleaning device 12 are all located in a replaceable cartridge, the housing for which is not shown in FIG. 1. The cartridge housing includes openings for exposure, toning and transfer.

Figure 2:
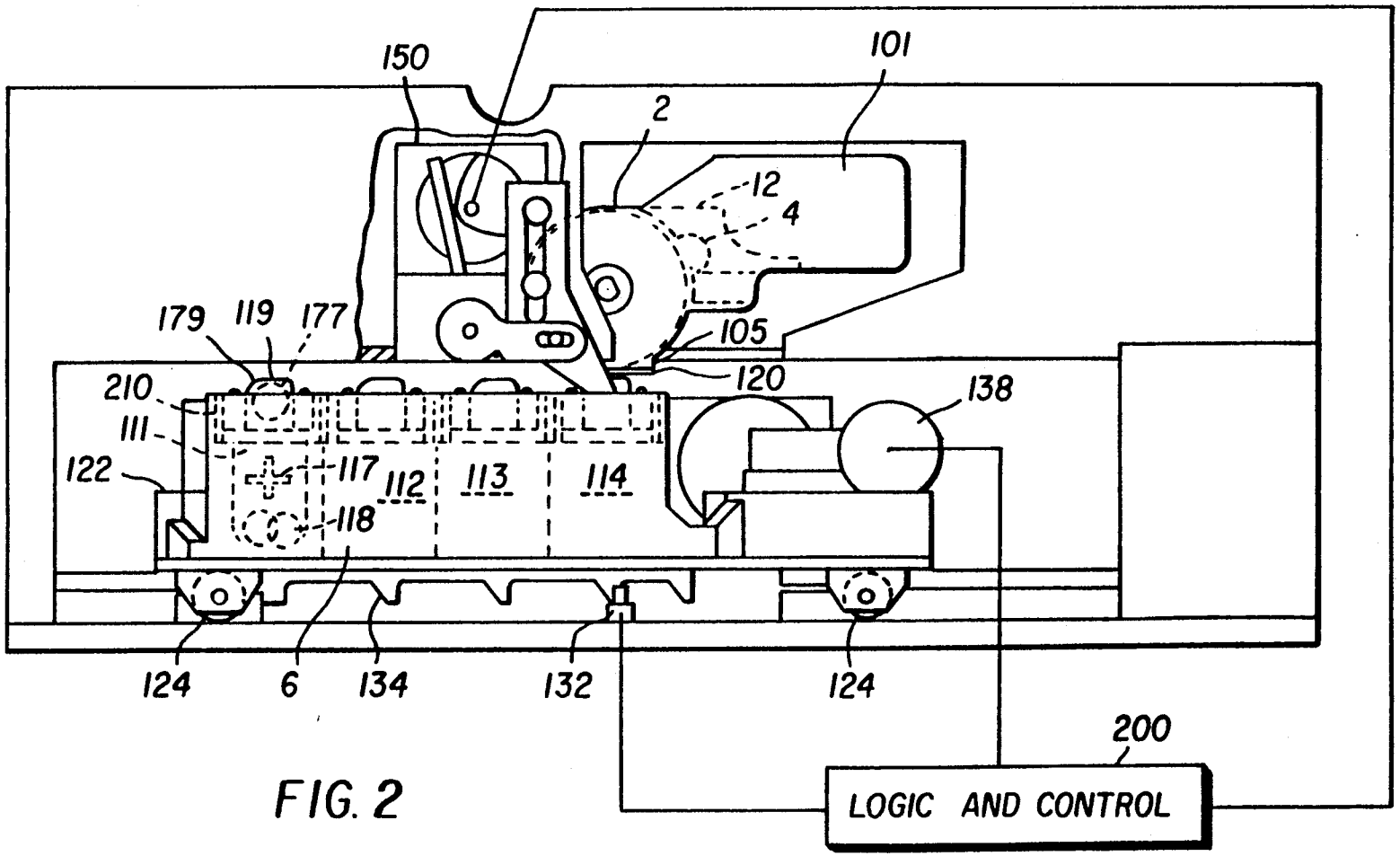
FIG. 2 is a front view of a developing device and image member cartridge portion of the apparatus shown in FIG. 1.
Figure 3:
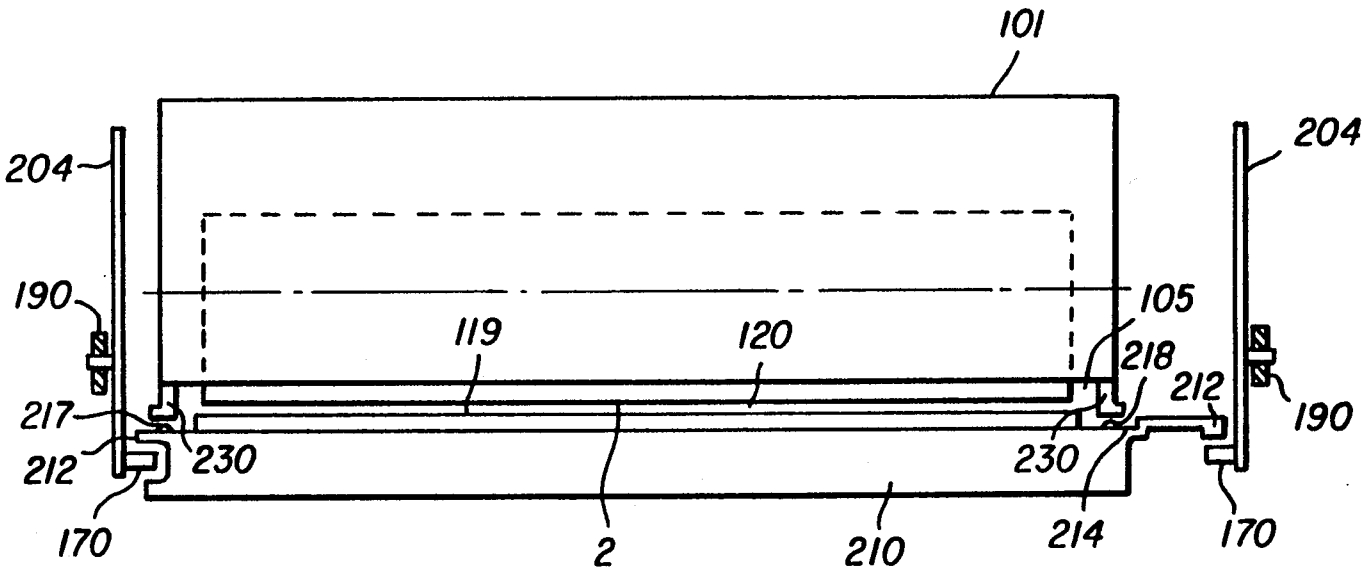
FIG. 3 is a side view with many parts eliminated illustrating the relationship of a lift mechanism, applicator assembly and photoconductor cartridge shown in FIG. 2.

According to FIGS. 2 and 3 photoconductive drum 2 is positioned in a cartridge 101, which cartridge also includes charger 4 and cleaning device 12. The cartridge is received in the image forming apparatus 1 and positioned with an opening aligned with laser 5 (FIG. 1) and photoconductive drum 2 in contact with transfer drum 10 (FIG. 1). The cartridge has a toning opening 105 through which electrostatic images on drum 2 are toned by toning device 6. (See also FIG. 10.)

Toning device 6 includes four toning units 111, 112, 113 and 114. Each of the units is of a type, known per se, which include (shown with respect to station 111 only) a sump in which two-component developer is continually mixed by a mixing blade 117 and augers 118 to supply two-component developer to an applicator 119. The applicator includes a stationary nonmagnetic shell 179 surrounding a rotatable magnetic core 177. Rotation of the core moves developer, including a hard magnetic carrier, around the shell and through toning relation with an electrostatic image positioned on an image member slightly spaced form the shell. Each applicator 119 is fixed in an applicator assembly 210 for vertical movement with respect to the rest of its unit 111, 112, 113 or 114. This is believed to be a sufficient explanation of the toning station. For more details, reference is made to U.S. Pat. application Ser. No. 07/621,681, referred to above, which application is incorporated by reference herein.

Electrostatic images formed on drum 2 are toned at a toning position 120 by application of toner from one of toning units 111, 112, 113 and 114. To apply the desired color toner to each electrostatic image, the toning units 111–114 are positioned in a carriage 122 which is movable through a linear path indexing each of the toning units through alignment with the toning position 120. The carriage 122 is supported on wheels 124 on the floor of the image forming apparatus 1 and is moved by a pinion (not shown) located on the carriage along a rack (not shown) fixed to the floor by a motor 138 on the carriage. For more details of this indexing mechanism, see U.S. Pat. application Ser. No. 07/632,706, filed Dec. 24, 1990(now abandoned), in the name of DeCecca et al. Toning units 111–114 can be separately removable units. Preferably, except for applicator 119, they are integrally formed with adjacent units sharing common walls.

An optical sensor 132 is located on the apparatus floor along the path of the toning units. One of four downward extending protrusions 134 corresponding to one of the toning units actuates the sensor 132 and signals a logic and control 200 for the apparatus that its unit is aligned with the toning position 120. Logic and control 200 immediately stops motor 138 to stop carriage 122 locating a toning unit in a position aligned with toning position 120. Logic and control 200 also signals lift mechanism 150 to lift the aligned applicator assembly 210 toward the toning position 120 and toning opening 105.

The lift mechanism 150 and its operation is best seen by reference to FIGS. 5 through 9. According to FIG. 5, logic and control 200 signals a lift mechanism motor 152 which rotates a cam means 154 which includes a cam 156. Cam means 154 has a pair of opposite polarity magnetic elements 158 which are sensed by a magnetic sensor 162 (for example, Digital Position Sensor #5546, marketed by Micro-Switch Products) to determine the orientation of cam means 154 and cam 156. Sensor 162 distinguishes between a north and south pole. One of magnetic elements 158 has its north pole facing sensor 162 and the other its south pole facing sensor 162, when aligned. Magnetic elements 158 can be permanent bar magnets, oppositely oriented. A signal indicative of orientation is sent to logic and control whenever one of elements 158 is aligned with sensor 162.

Rotation of cam 156 moves a cam follower, for example a lever 164, around a pivot defined by the axis of rotation of a shaft 166. Cam 156 is shaped and positioned to rotate lever 164 through about 16° of rotation.

Figure 5:
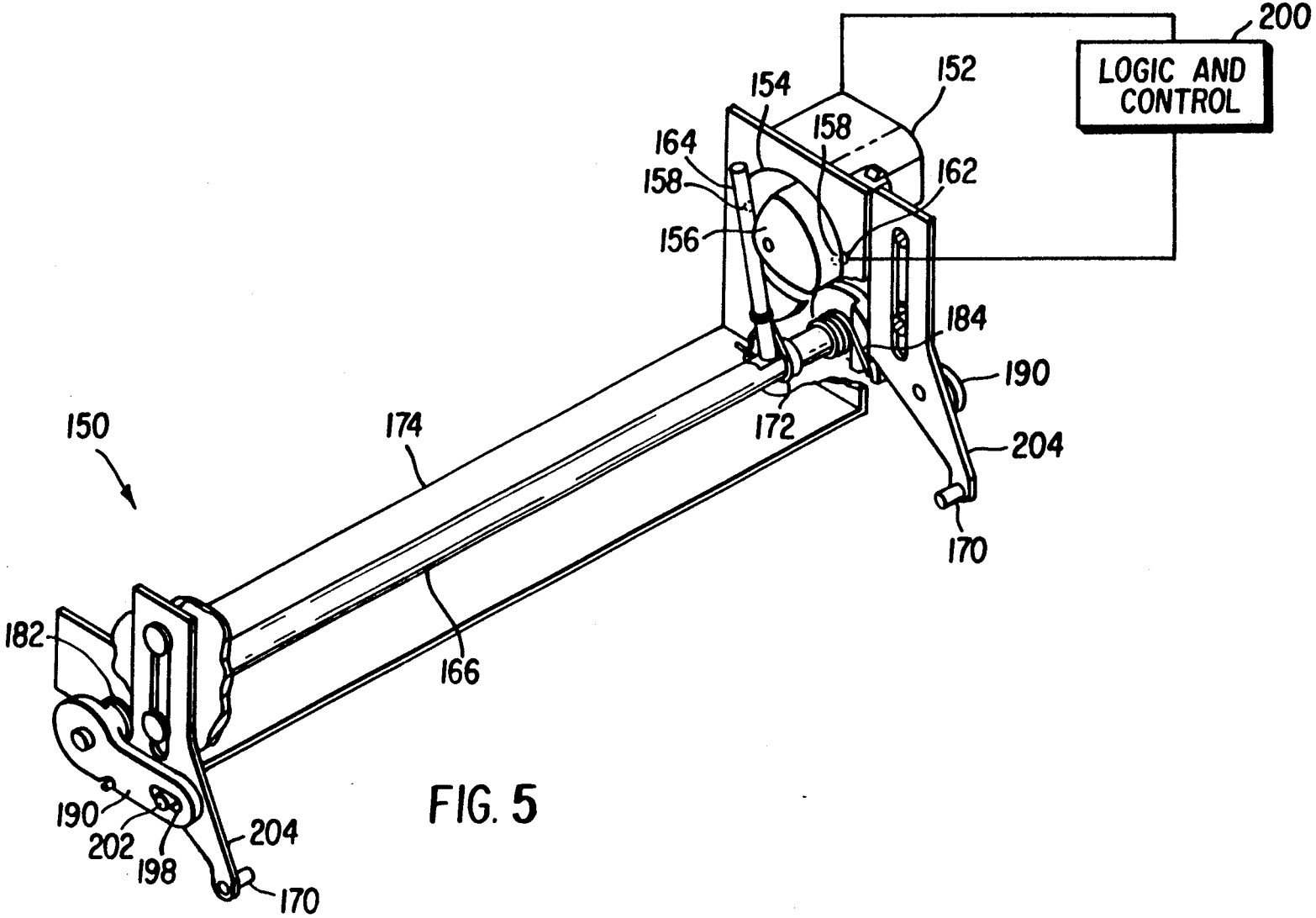
FIG. 5 is a perspective view of a lift mechanism shown in FIGS. 2 and 3.
Figure 6:
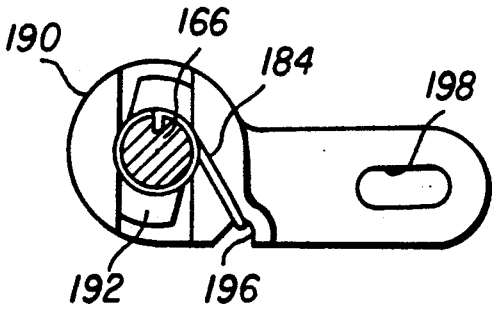
FIGS. 6 and 7 are front and top views of a component of the lift mechanism shown in FIG. 5.
Figure 7:
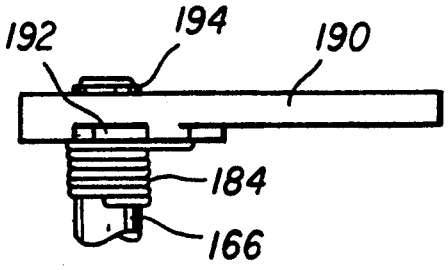

Rotation of shaft 166 by lever 164 raises and lowers pins 170 through a resilient coupling shown in FIGS. 5–7.

Referring to FIGS. 5–7, a torsion spring 172 (FIG. 5) fits over shaft 166 and forces lever 164 against cam 156, i.e., in a clockwise direction as seen in FIG. 5. The shaft 166 rotates in two holes in the front and rear of a bracket 174 which supports the entire lift mechanism 150. The shaft 166 has two grooves that hold torsion springs 182 and 184 at opposite ends of shaft 166. As seen in FIGS. 6 and 7, torsion spring 184 is slid over the end of shaft 166. A tab on each torsion spring is slid into a short groove on shaft 166. A diamond-shaped drive key 192 is slid onto a "D"-shaped end of shaft 166. The key is trapped in a slot of a pivoting lift 190 which fits over key 192 and is held on shaft 166 by a retaining ring 194. The front end of the shaft 166 is assembled in the same manner using torsion spring 182. The torsion springs 182 and 184 have an end away from shaft 166 that is hooked around a slot 196 in pivoting lifts 190. Rotation of shaft 166 by lever 164 causes springs 182 and 184 to also rotate pivoting lift 190. The spring forces at the slots in pivoting lifts 190 are between 1 and 2 pounds each. A slot 198 in each of lifts 190 raises a pin 202 fixed to a toning lift 204. Each toning lift 204 carries one of lift pins 170. This design creates a compliant or resilient rotational lift. In this design the two torsion springs 182 and 184 do the actual lifting of pins 170 through the pivoting lifts 190.

Figure 4:
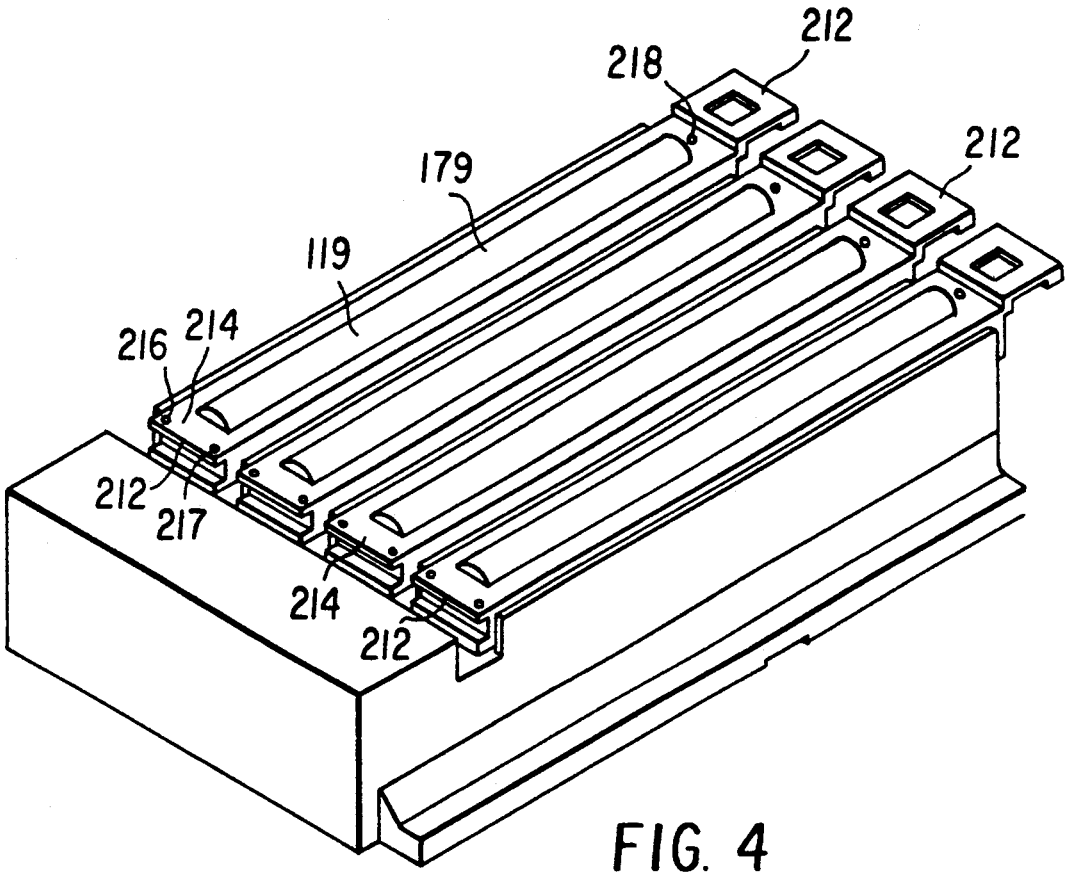
FIG. 4 is a perspective view of a toning unit carriage illustrating four applicator assemblies.

Referring to FIGS. 3 and 4, pins 170 are positioned to fit directly under a pair of ledges 212 fixed to applicator assembly 210. Applicator assembly 210 also has a top positioning surface 214 containing positioning protrusions 216, 217 and 218. Protrusions 216 and 217 are shown in FIG. 4 at the front end of the applicator assembly, while positioning protrusion 218 is shown at the rear of the applicator assembly. As seen in FIG. 3, the ledges 212 allow the applicator assemblies 210 to move with the linear movement of the toning units without engaging pins 170, which are positioned just below the path of ledges 212, when a toning unit is positioned in alignment with the toning position 120, as sensed by sensor 132(FIG. 2), logic and control 200 turns on motor 152 (FIG. 5) to rotate cam means 154 to thereby rotate lever 164 in a counter-clockwise direction. Rotation of lever 164 causes torsion springs 182 and 184 to rotate pivoting lifts 190 also in a counter-clockwise direction. Rotation of pivoting lifts 190 counter-clockwise raises toning lifts 204 to raise pins 170. Pins 170 engage the bottom of ledges 212 and raise applicator assembly 210 until protrusions 216, 217 and 218 rest on a flat positioning surface 230 on the cartridge 101. Further rotation of lever 164 and shaft 166 merely tensions torsion springs 182 and 184, the system bottoming out when the protrusions 216, 217 and 218 seat on surface 230. The torsion springs, thus, provide compliance and resiliency to a coupling between the cam means 154 and the applicator assembly 210 to move the applicator assembly toward the toning position and against the cartridge positioning surface.

Cartridge positioning surface 230 (FIGS. 3, 8, 9 and 10) includes two flat coplanar positioning surfaces beyond the ends of photoconductive drum 2 which are generally perpendicular to a plane passing through the axis of rotation of photoconductive drum 2 and the middle of the toning position 120 and toning opening 105. The positioning surfaces 230 can define the ends of toning opening 105 in the housing of cartridge 101, or be adjacent the ends of the opening, as shown in FIG. 10. The use of three protrusions 216, 217 and 218 to contact cartridge positioning surfaces 230 assures a fully constrained positioning system. The use of just flat surfaces to accomplish the same positioning would be comparable to the use of four or more protrusions, which would be overconstrained (like a four-legged stool).

Figure 8:
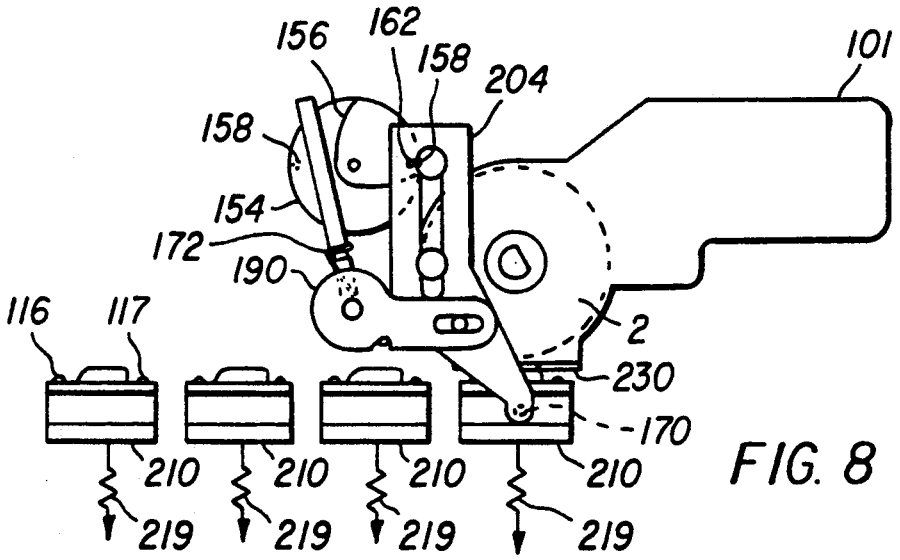
FIGS. 8 and 9 are front views illustrating the movement of the lift mechanism with respect to the applicator assembly and image member cartridge.
Figure 9:
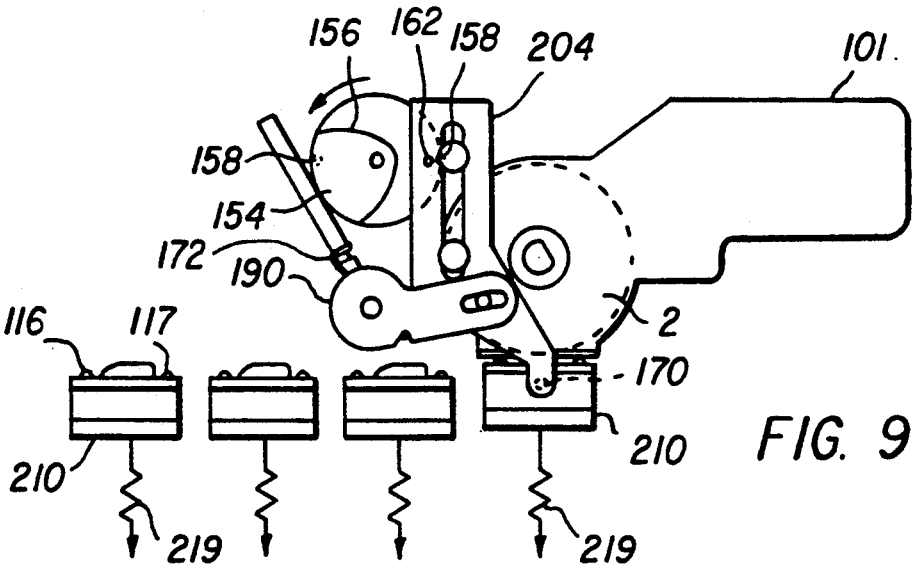
Figure 10:
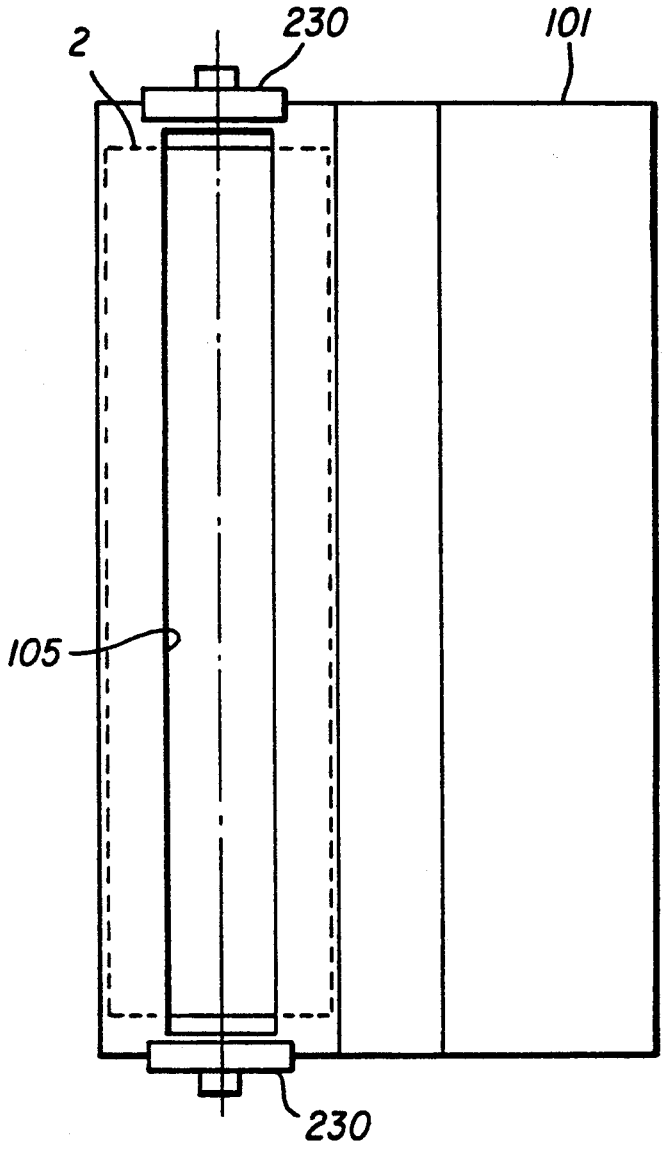
FIG. 10 is a bottom view of an image member cartridge illustrating a development opening and associated positioning surfaces.

The movement of pins 170 in response to rotation of cam means 154 is illustrated in FIGS. 8 and 9, with FIG. 8 showing the position of both the cam means and the resilient coupling means as the toning unit becomes aligned with the toning position as sensed by sensor 132. In this position sensor 162 is interrogated by logic and control 200 to find that the cam means 154 is in the "down" position. Logic and control 200 activates motor 152 to rotate cam means 154 in a counter-clockwise direction to the position shown in FIG. 9 until sensor 162 senses the arrival of the second indicating means 158. At this point, the motor is stopped. The rotation of cam means 154 has positioned the applicator assembly 210 in its raised and operative positions as described above.

Also as shown in FIGS. 8 and 9, the return of the applicator assembly 210 to its "down" position is accomplished by an independent spring 219 which constantly urges the applicator assembly to the "down" position. Thus, when a different color toner is called for, logic and control 200 again activates motor 152 which rotates cam means 154 until sensor 162 senses element 158, indicative that cam means 154 is in its first position. This lowers pins 170, allowing spring 219 to return applicator assembly 210 to its "down" position. The signal from sensor 162 that cam means 154 is in its first position also is used by logic and control 200 to again turn on motor 138 to begin the next indexing motion of carriage 122.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus having an image member or means for receiving an image member on which image member an electrostatic image is formable, said image forming apparatus comprising:

means for applying toner to an electrostatic image on the image member to form a toner image corresponding to the electrostatic image, said toner applying means including, a plurality of toning units indexible into alignment with a toning position, each toning unit including an applicator assembly movable with respect to the rest of the toning unit toward and away from the toning position, each applicator assembly including a pair of ledges extending from opposite ends, means for moving the applicator assembly of a toning unit positioned in alignment with the toning position toward the toning position, which means includes a pair of pins located adjacent opposite ends of an applicator assembly positioned opposite the toning position and means for moving the pins from a first position toward the toning position to engage the underside of said ledges to move the applicator assembly toward the toning position, said pins being positioned when in the first position such that said ledges pass over said pins during indexing movement of the toning units.

2. Image forming apparatus comprising:

an image member, means for forming an electrostatic image on said image member, means for applying toner to said electrostatic image to form a toner image corresponding thereto, said applying means including, a plurality of toning units indexible into alignment with a toning position associated with said image member, each toning unit including an applicator assembly movable with respect to the rest of the unit toward the toning position, means permanently associated with the toning position for engaging the applicator assembly and for moving the applicator assembly toward the toning position, cam means rotatable between first and second positions, coupling means resiliently coupling the cam means and the engaging means to resiliently urge the applicator assembly toward the toning position in response to movement of the cam means from its first to its second position, and means for rotating the cam means from its first to its second position in response to arrival of a toning unit in alignment with the toning position.

3. Image forming apparatus according to claim 2 further including means for sensing arrival of a toning unit in alignment with the toning position, and for creating a signal in response to sensing such arrival, a motor for rotating said cam means between its first and second positions and logic and control means responsive to said signal for controlling said motor to drive said cam means from its first to its second positions.

4. Image forming apparatus according to claim 2 wherein said image member is drum-shaped and is rotatable about an axis of rotation and wherein each of said applicator assemblies is elongated in a direction generally parallel to said axis of rotation and has a ledge extending from each end of said applicator assembly, which ledge is engageable by said engaging means for movement of the applicator assembly toward the toning position.

5. Image forming apparatus according to claim 4 wherein said engaging means is two pins, each pin being engageable with one of said ledges and being positioned generally below its respective ledge when the cam means is in its first position with said ledge passing above said pin during indexing movement of the toning units.

6. Image forming apparatus according to claim 5 wherein each of said pins is fixed to a separate lift member and said apparatus further includes cam follower means resiliently coupled to said lift member for lifting said lift member in response to movement of the cam means between its first and second positions.

7. Image forming apparatus according to claim 6 wherein said cam follower means is rigidly fixed to a shaft for rotation with said shaft about an axis of rotation of said shaft in response to rotation of said cam means, said apparatus further includes a pair of pivoting lifts resiliently connected to said shaft for rotation in response to rotation of said shaft, said pivoting lifts in turn raising said lift members and said pins in response to movement of said cam means from its first to its second positions.

8. Image forming apparatus according to claim 7 wherein said resilient connection between said shaft and said pivoting lifts is a torsion spring fixed to said shaft and said pivoting lift for resiliently rotating said pivoting lift with said shaft.

9. Image forming apparatus according to claim 2 wherein said cam means includes a pair of separately identifiable indicators equally spaced from an axis of rotation of said cam means and said apparatus includes means for sensing and distinguishing between said indicators, said apparatus further including a logic and control connected to said means for sensing, said means for sensing and indicators being positioned to provide an indication to said logic and control as to whether said cam means is in its first or its second position.

10. Image forming apparatus according to claim 9 wherein said indicators are north and south pole magnets, respectively, and said means for sensing includes means discriminately responsive to north and south pole magnetic fields.

11. Image forming apparatus comprising:

a photoconductor cartridge having a housing, a photoconductive drum mounted for rotation about an axis of rotation within said housing, means defining an elongated toning opening in said housing running generally parallel to said axis of rotation closely adjacent an outside surface of said drum, and two cartridge positioning surfaces, one located adjacent each end of the toning opening, said surfaces being coplanar and generally perpendicular to a plane through the axis of rotation and the toning opening, means for forming an electrostatic image on said photoconductive drum, means for applying toner to said electrostatic image to form a toner image corresponding thereto, said applying means including, a plurality of toning units indexible into alignment with said toning opening, each toning unit including an applicator assembly movable with respect to the rest of the unit toward the toning opening, resilient means actuatable for moving an applicator assembly of a toning unit positioned in alignment with the toning opening toward the toning opening, said applicator assembly including a pair of ledges extending from opposite ends, a surface generally facing said toning opening and having three positioning protrusions from said surface, said three protrusions being positioned to engage the positioning surface of the cartridge in response to movement of the applicator assembly toward the toning opening, cam means rotatable between first and second positions, and a pair of pins located adjacent opposite ends of the applicator assembly for engaging the underside of said ledges for moving the applicator assembly toward the toning position, which pins are positioned when said cam means is in its first position so that said ledges may pass over said pins during indexing movement of the toning units, and coupling means resiliently coupling the cam means and said pins to resiliently urge the applicator assembly toward the toning position.

* * * * *